US008556087B2

(12) United States Patent
Andersson et al.

(10) Patent No.: US 8,556,087 B2
(45) Date of Patent: Oct. 15, 2013

(54) ARRANGEMENT FOR THE TREATMENT OF CELLULOSE PULP IN A WASHING APPARATUS ARRANGED WITH A REINFORCING FRAME

(75) Inventors: Rickard Andersson, Matfors (SE); Johan Bylander, Sundsvall (SE); Magnus Henriksson, Sundsvall (SE); Jörgen Lundberg, Sundsvall (SE)

(73) Assignee: Metso Paper, Inc. (FI)

( * ) Notice: Subject to any disclaimer, the term of this patent is extended or adjusted under 35 U.S.C. 154(b) by 1353 days.

(21) Appl. No.: 11/885,196

(22) PCT Filed: Jun. 2, 2006

(86) PCT No.: PCT/SE2006/000654
§ 371 (c)(1), (2), (4) Date: Aug. 28, 2007

(87) PCT Pub. No.: WO2006/130089
PCT Pub. Date: Dec. 7, 2006

(65) Prior Publication Data
US 2008/0264113 A1 Oct. 30, 2008

(30) Foreign Application Priority Data
Jun. 3, 2005 (SE) ..... 0501279-4

(51) Int. Cl.
*D21C 9/06* (2006.01)
*B01D 33/06* (2006.01)

(52) U.S. Cl.
USPC ..... 210/402; 210/403; 210/404

(58) Field of Classification Search
USPC ..... 210/402, 403, 404
See application file for complete search history.

(56) References Cited

U.S. PATENT DOCUMENTS 1,667,465 A * 4/1928 Wait ..... 210/768
2,005,839 A * 6/1935 Edge ..... 162/329
(Continued)

FOREIGN PATENT DOCUMENTS

DE 2645704 A1 4/1978
GB 476713 A 12/1937
(Continued)

OTHER PUBLICATIONS

International Preliminary Report on Patentability for PCT/SE2006/000654, dated Dec. 6, 2007.*
(Continued)

*Primary Examiner* — David A Reifsnyder
(74) *Attorney, Agent, or Firm* — Lerner, David, Littenberg, Krumholz & Mentlik, LLP

(57) ABSTRACT

The present invention relates to a washing apparatus for washing of cellulose pulp comprising: a rotatable drum (2), a stationary support (14), a stationary cylindrical casing (18), that encloses the drum, whereby an annular space (20) is defined between the casing and the drum, a number of seals (22) that are arranged on the casing and that seals between the casing and the drum, such that the annular space is divided in a formation zone (F), at least one washing zone (T1, T2), and a discharge zone (U), and at least a reinforcing frame rib (24), that is attached to the casing. The reinforcing frame rib (24) extends around the entire casing (18) for fixing the casing in a predetermined form, whereby detrimental deformation of the casing (18), when washing the paper pulp at overpressure, is prevented.

9 Claims, 2 Drawing Sheets

(56) References Cited

U.S. PATENT DOCUMENTS

Figure 1A:
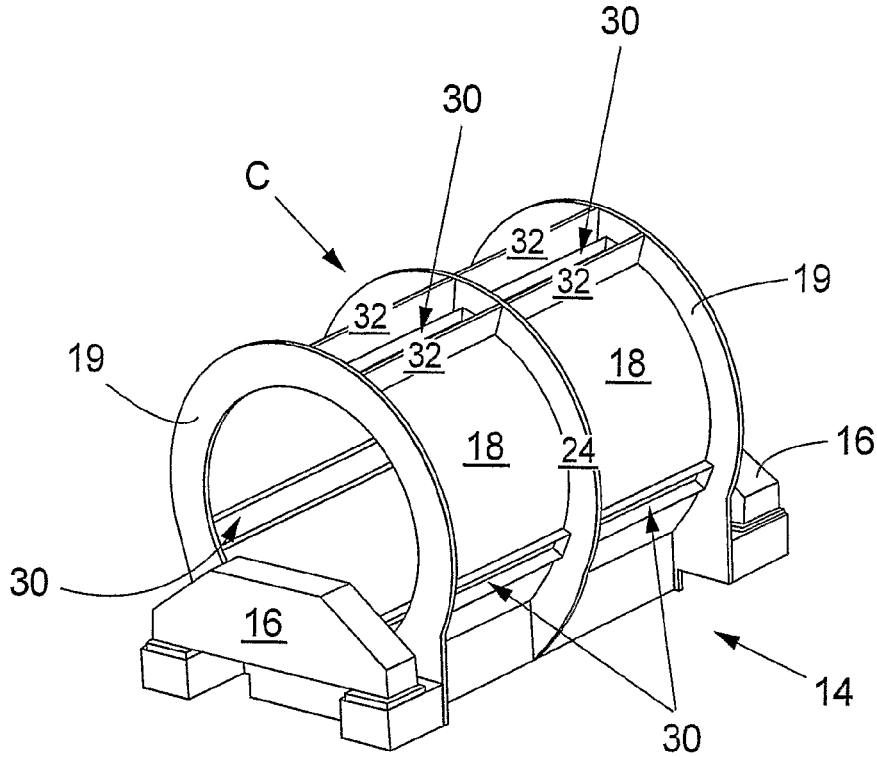

| | | | | | |
|---|---|---|---|---|---|
| 2,280,501 | A | | 4/1942 | Stephenson | |
| 2,352,304 | A | * | 6/1944 | Young | 210/798 |
| 2,478,150 | A | * | 8/1949 | Young | 96/180 |
| 2,592,490 | A | * | 4/1952 | Thompson | 208/38 |
| 2,741,369 | A | * | 4/1956 | Fest | 210/217 |
| 2,839,194 | A | * | 6/1958 | Lopker et al. | 210/772 |
| 2,963,158 | A | * | 12/1960 | Jung | 210/86 |
| 3,220,340 | A | * | 11/1965 | Frykhult | 100/121 |
| 3,342,124 | A | * | 9/1967 | Frykhult | 100/121 |
| 3,363,774 | A | * | 1/1968 | Luthi | 210/404 |
| 3,403,786 | A | * | 10/1968 | Luthi | 210/217 |
| 3,409,139 | A | * | 11/1968 | Kristofl et al. | 210/404 |
| 3,487,941 | A | * | 1/1970 | Haapamaki | 210/404 |
| 3,587,863 | A | * | 6/1971 | Kristofl | 210/404 |
| 3,616,660 | A | * | 11/1971 | Ingermarsson | 68/22 R |
| 3,667,614 | A | * | 6/1972 | Komline | 210/401 |
| 3,772,144 | A | * | 11/1973 | Luthi et al. | 162/210 |
| 3,807,202 | A | * | 4/1974 | Gunkel | 68/181 R |
| 3,878,698 | A | * | 4/1975 | Friksson et al. | 68/22 R |
| 4,085,003 | A | * | 4/1978 | Luthi | 162/259 |
| 4,182,680 | A | * | 1/1980 | Carle | 210/386 |
| 4,217,170 | A | * | 8/1980 | Luthi | 162/380 |
| 4,266,413 | A | * | 5/1981 | Yli-Vakkuri | 68/158 |
| 4,283,285 | A | * | 8/1981 | Paschen et al. | 210/326 |
| 4,292,123 | A | * | 9/1981 | Lintunen et al. | 162/60 |
| 4,430,557 | A | | 2/1984 | Eichelberger et al. | |
| 4,491,501 | A | * | 1/1985 | Klein | 162/60 |
| 4,502,171 | A | * | 3/1985 | Koskinen et al. | 5/156 |
| 4,505,137 | A | * | 3/1985 | Klein | 68/62 |
| 4,581,139 | A | * | 4/1986 | Kosonen | 210/232 |
| 4,750,340 | A | * | 6/1988 | Anderson | 68/43 |
| 4,769,986 | A | * | 9/1988 | Kokkonen et al. | 68/181 R |
| 4,808,265 | A | * | 2/1989 | Luthi et al. | 162/60 |
| 4,827,741 | A | * | 5/1989 | Luthi | 68/43 |
| 4,840,704 | A | * | 6/1989 | Seymour | 162/49 |
| 4,894,121 | A | * | 1/1990 | Luthi et al. | 162/329 |
| 4,919,158 | A | * | 4/1990 | Kokkonen et al. | 134/15 |
| 4,952,314 | A | * | 8/1990 | Henricson et al. | 210/404 |
| 5,046,338 | A | * | 9/1991 | Luthi | 68/43 |
| 5,073,264 | A | * | 12/1991 | Immonen et al. | 210/404 |
| 5,116,423 | A | * | 5/1992 | Kokkonen et al. | 134/15 |
| 5,139,671 | A | * | 8/1992 | Henricson et al. | 210/398 |
| 5,186,791 | A | * | 2/1993 | Seifert et al. | 162/56 |
| 5,192,454 | A | * | 3/1993 | Immonen et al. | 210/780 |
| 5,213,686 | A | * | 5/1993 | Funk et al. | 210/350 |
| 5,282,131 | A | * | 1/1994 | Rudd et al. | 700/44 |
| 5,290,454 | A | * | 3/1994 | Dorica et al. | 210/710 |
| 5,421,176 | A | * | 6/1995 | Ojala et al. | 68/43 |
| 5,437,599 | A | * | 8/1995 | Feldkamp et al. | 494/82 |
| 5,460,019 | A | * | 10/1995 | Ojala et al. | 68/43 |
| 5,656,162 | A | * | 8/1997 | Nilsson | 210/236 |
| 5,722,264 | A | * | 3/1998 | Antkowiak | 68/43 |
| 5,842,242 | A | * | 12/1998 | Antkowiak | 8/156 |
| 5,965,017 | A | * | 10/1999 | Nelson et al. | 210/217 |
| 5,985,159 | A | * | 11/1999 | Strid et al. | 210/783 |
| 6,004,468 | A | * | 12/1999 | Barbulescu et al. | 210/739 |
| 6,006,554 | A | * | 12/1999 | Gallagher | 68/181 R |
| 6,017,416 | A | * | 1/2000 | Judd | 162/60 |
| 6,042,735 | A | * | 3/2000 | Gommel et al. | 210/770 |
| 6,106,669 | A | * | 8/2000 | Gommel et al. | 162/56 |
| 6,151,931 | A | * | 11/2000 | Doelle | 68/205 R |
| 6,162,326 | A | * | 12/2000 | Gommel et al. | 162/100 |
| 6,440,265 | B1 | * | 8/2002 | Judd | 162/60 |
| 6,502,434 | B1 | * | 1/2003 | Doelle | 68/205 R |
| 6,631,810 | B1 | * | 10/2003 | Lamas et al. | 210/402 |
| 7,695,591 | B2 | * | 4/2010 | Lundberg et al. | 162/52 |
| 2005/0051473 | A1 | * | 3/2005 | Suss et al. | 210/345 |
| 2007/0210015 | A1 | * | 9/2007 | Egan, III | 210/787 |
| 2008/0061011 | A1 | * | 3/2008 | Schmid | 210/769 |
| 2008/0264113 | A1 | * | 10/2008 | Andersson et al. | 68/93 |
| 2008/0314541 | A1 | * | 12/2008 | Lundberg et al. | 162/232 |
| 2009/0078382 | A1 | * | 3/2009 | Mattsson et al. | 162/52 |
| 2009/0101298 | A1 | * | 4/2009 | Lundberg et al. | 162/232 |
| 2009/0218065 | A1 | * | 9/2009 | Lundberg et al. | 162/380 |
| 2009/0229778 | A1 | * | 9/2009 | Lundberg et al. | 162/380 |
| 2009/0301529 | A1 | * | 12/2009 | Lundberg et al. | 134/115 R |

FOREIGN PATENT DOCUMENTS

| | | | | |
|---|---|---|---|---|
| WO | WO-97/10380 | A1 | | 3/1997 |
| WO | WO-00/73579 | A1 | | 12/2000 |
| WO | WO 2006130089 | A1 | * | 12/2006 |

OTHER PUBLICATIONS

Third Part Observations for European Patent Application No. 06747848.7, dated Apr. 9, 2012.*

Opposition filed on Sep. 24, 2007 in Swedish Priority Application No. SE 050129-4.

Affidavit of Ville Varis Oct. 19, 2009.

Brochure "DD W Ashers in Chemical Pulping", 1990.

Brochure "Ravma-Repola Vacuum Washer", 1978.

Drawing "DD3040.I ,2MC", 2003.

Supplementary affidavit by Ville Varis, Mar. 7, 2011.

Papermaking Science and Technology, Book 6A, Chemical Pulping, 1999.

FiberSpectrum, Issue 14—No. 2/2006, Andritz AG.

Affidavit by Allen Turner Apr. 7, 2011 with attachment (DD Washer Background).

Programme and list of participants for 2004 DD Washer Round Table.

* cited by examiner

ARRANGEMENT FOR THE TREATMENT OF CELLULOSE PULP IN A WASHING APPARATUS ARRANGED WITH A REINFORCING FRAME

CROSS-REFERENCE TO RELATED APPLICATIONS

The present application is a national phase entry under 35U.S.C. §371 of International Application No. PCT/SE2006/000654 filed Jun. 2, 2006, published in English, which claims priority from Swedish Application No. 05601279-4 filed Jun. 3, 2005, all of which are incorporated herein by reference.

The present invention relates to a washing apparatus for washing of cellulose pulp.

In all fibre lines, some kind of washing equipment for separating the liquor of the digestion from the pulp is included. Washing equipment is included later on in the process for separation of bleach liquors after bleaching stages. There are a number of different kinds of washing equipments-operating according to various principles.

One well-known kind of washing apparatus is the drum washer where the pulp is dewatered on a rotatable filter drum after addition of washing liquid that displaces the liquor remaining in the pulp web after preceding process stages, e.g. a digestion stage or bleaching stage. The static pressure causes the displaced liquid to pass through a perforated metal sheet arranged on the rotatable drum. A further development of the original drum washer is the pressurized displacement washer, where the filtrate at overpressure is caused to pass through the metal sheet. The increase in the pressure difference results in an improved dewatering of the pulp. In the pressurized displacement washer, the increase in pressure difference may result in that the pulp web gets stuck harder towards the metal sheet of the drum and sometimes has to be removed by some kind of aid. Then, the pulp web can be unfastened for example by means of liquid or air.

According to a known design of a pressurized displacement washer, the drum is provided with compartments in which the pulp locates itself in long and narrow rectangles towards the metal sheet in the axial direction of the drum. The subdivision in compartments of the drum ensures that the pulp cake does not break up and moves, but instead maintains the form produced at application on the pulp. The compartments are made up of compartment walls arranged axially along the whole axle of the drum. The perforated metal sheet, on which the pulp deposits, is located on a distance from the axle of the drum such that filtrate channels are formed in the space between the drum and the metal sheet. Thus, there are at least as many filtrate compartments as pulp compartments along the circumference of the drum. In a drum washer, a number of various washing stages can be carried out, with separate addition of washing liquid to the various stages and also return of filtrate from a stage as washing liquid to another.

In order to maintain maximal washing efficiency, it is desirable to assure that washing liquid intended for a specific washing stage not is transferred to a subsequent washing stage. A pressure difference between the stages results in that added washing liquid strives for moving itself towards the lower pressure. For the purpose of being able to separate different washing stages, that are carried out in one washing zone on the drum, and also formation stage, that is carried out in a formation zone on the drum, and discharge stage (increased pulp concentration zone forms a first part of the discharge zone), that is carried out in a discharge zone on the drum, the respective zones are sealed with axial seals. The axial seals are located between the rotating drum and the surrounding casing. The filtrates from the zones, respectively, are separated by seals in a peripheral end valve arranged at one or both of the gables of the drum. Known washing apparatuses for washing of paper pulp, which are based on the principle of counter-current washing with compartmented drum, have a relatively high dead weight. The reason is that the axial seals, between atmospheric and pressurized spaces, as well as between washing zones, are extremely sensitive for geometrical deviations. It is of the utmost importance for the function of the washing apparatus that the gap between a seal and the drum is reduce to a minimum and is kept constant. If that is not the case, leakage of filtrate arises either between washing zones or to spaces that are not pressurized. The geometrical deviations originate above all due to the internal overpressure that is utilized at washing. For the purpose of minimising the deformation, and by that increasing the efficiency and the functionality of the washing apparatus, the supporting structure on existing washing apparatuses is very heavy and solid, since it is composed of a strong framework arranged outside the surrounding casing that encloses the pressurized space. These frameworks in known washing apparatuses comprises a number of heavy duty beams in the longitudinal direction of the casing, axially the drum, and a plurality of solid stiffening metal sheets arranged at the upper part of the washing apparatus. High weight means high cost of production owing to large consumption of material and complicated operations at manufacture. The high dead weight also presents a problem when setting up the washing apparatus. A large overhead travelling crane capacity is required, the transportations becomes more difficult and increase in prices, and also very heavy foundations and supporting cables are required in buildings in order to manage the high dead weight.

The present invention aim to achieve an improved washing apparatus where at least partly the drawbacks associated with what is previously known, according to the state of the art, can be eliminated. Yet an object is to provide a washing apparatus that minimises the deformation in the pressurised part of the washing apparatus and at the same time has a lowered dead weight compared to known washing apparatuses according to the state of the art, and also a washing apparatus that can be manufactured cost-efficiently and in a labour-saving way.

These objects are achieved with a washing apparatus for washing of cellulose pulp according to the present invention. The washing apparatus comprises: a rotatable drum, provided with a number of outer compartments for the paper pulp to be washed, which compartments are defined by axial compartment walls and distributed along the circumference of the drum; a stationary support having two opposite transverse beams, whereby the drum extends between the transverse beams and is rotatably journalled on both of the transverse beams of the support; a stationary cylindrical casing, having two opposite gables, that encloses the drum, whereby an annular space is defined between the casing and the drum; a number of seals that are arranged on the casing and that seals between the casing and the compartment walls of the compartments, such that the annular space is divided in a formation zone for forming of the pulp in the compartments of the drum, at least one washing zone for washing of the formed pulp at overpressure, and a discharge zone for discharge of the washed pulp from the annular space; and at least a reinforcing frame rib, that is attached to the casing between the gables. The invention is characterised in that the reinforcing frame rib extends around the entire casing for fixing the casing in a predetermined form, whereby detrimental deformation of the casing when washing the paper pulp in the pressurized spaces is prevented, and that the casing forms a longitudinal discharge opening, relatively the axial extension of the drum, for washed pulp that is discharged from the discharge zone, and where the reinforcing frame rib extends straight across the discharge opening of the casing.

Thanks to the configuration with an "encircling" frame rib that extends around the entire casing, the heavy load-bearing structures in the shape of heavy frameworks, having a plurality of heavy metal sheets and beams in known washing apparatuses according to the state of the art, can be eliminated to a great extent. A considerable lower dead weight and a more simple construction of the washing apparatus according to the present invention can be obtained compared to known washing apparatuses. Altogether, the construction is permitted to have a considerable lower dead weight but with a maintained function than a corresponding washing apparatus according to the state of the art. A washing apparatus according to the present invention results in a better utilization of material, since the same small deformations can be obtained as with washing apparatuses according to the state of the art, but with less consumption of material.

The reinforcing frame rib extents around the entire casing, but need not to be arranged without interruption around the casing, but can preferably be divided in sections that are fixed to each other, e.g. with screw joint reinforcement. Suitably the frame rib is divided in two sections, one upper section that extends around the upper half around the casing and a lower section that extends around the lower section of the casing. The drum may suitably be provided with at least an outer encircling ring, that extends in the circumferential direction of the drum and is located axially opposed to the reinforcing frame rib in order to avoid built up of pulp on the frame rib at the discharge opening. The purpose of the ring is to prevent that pulp is allowed to be formed in the portion of the compartment that corresponds to the axial position of the reinforcing frame rib. If the frame rib is divided in several sections, such as an upper and a lower section, the lower section extends straight across the discharge opening of the casing.

Advantageously, it can be sufficient to only utilize one single reinforcing frame rib, although if, within the scope of the invention in its most general extent, it is not excluded to use more than one frame rib. An advantage by the preferred embodiment to utilize only one reinforcing frame rib is that an above mentioned longitudinal discharge opening in the casing for discharge of washed pulp, which discharge opening extends relatively the axial extension of the drum, only becomes blocked over one single position where the single frame rib passes across the discharge opening.

According to yet a preferred embodiment, the casing may have a number of oblong openings that extends axially relatively the drum, the seals are arranged in the openings, and the reinforced frame rib extends straight across the oblong openings of the casing. Preferably, stiffened wall portions can be fixed between the gables and the frame rib along and adjacent to the openings.

Figure 1B:
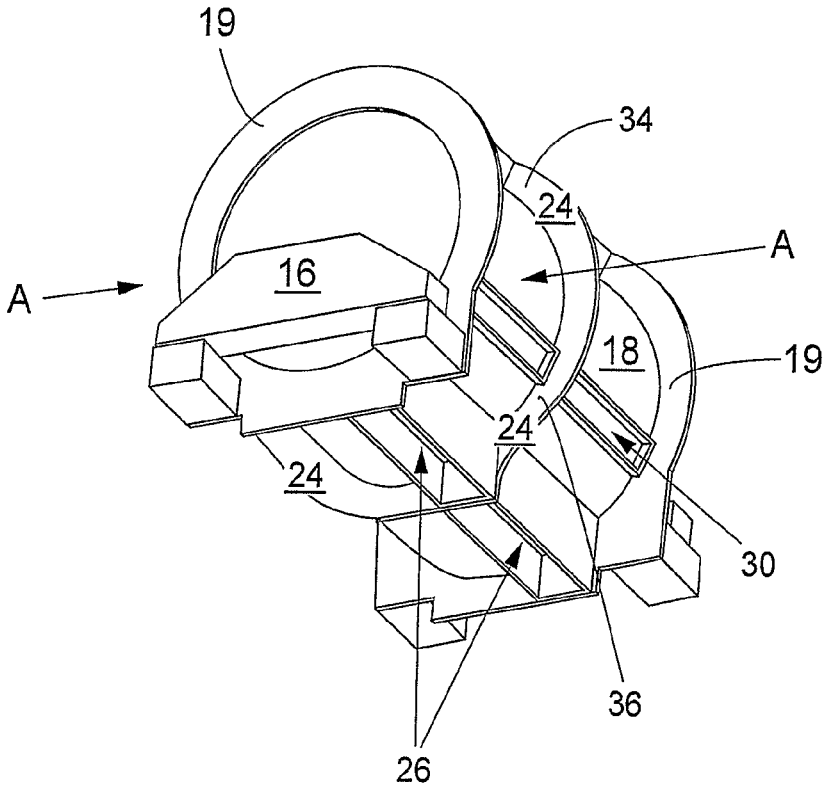
Figure 2:
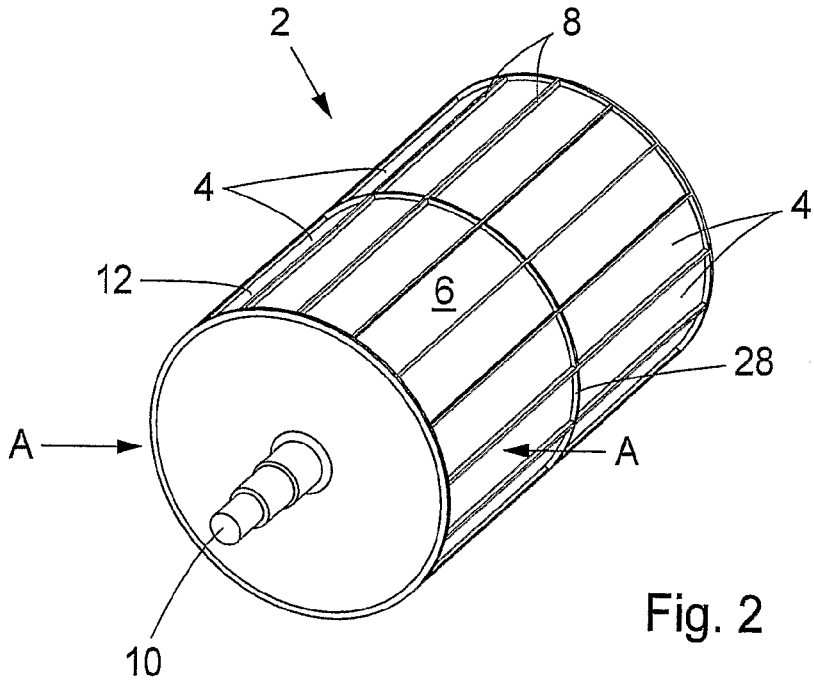
Figure 3:
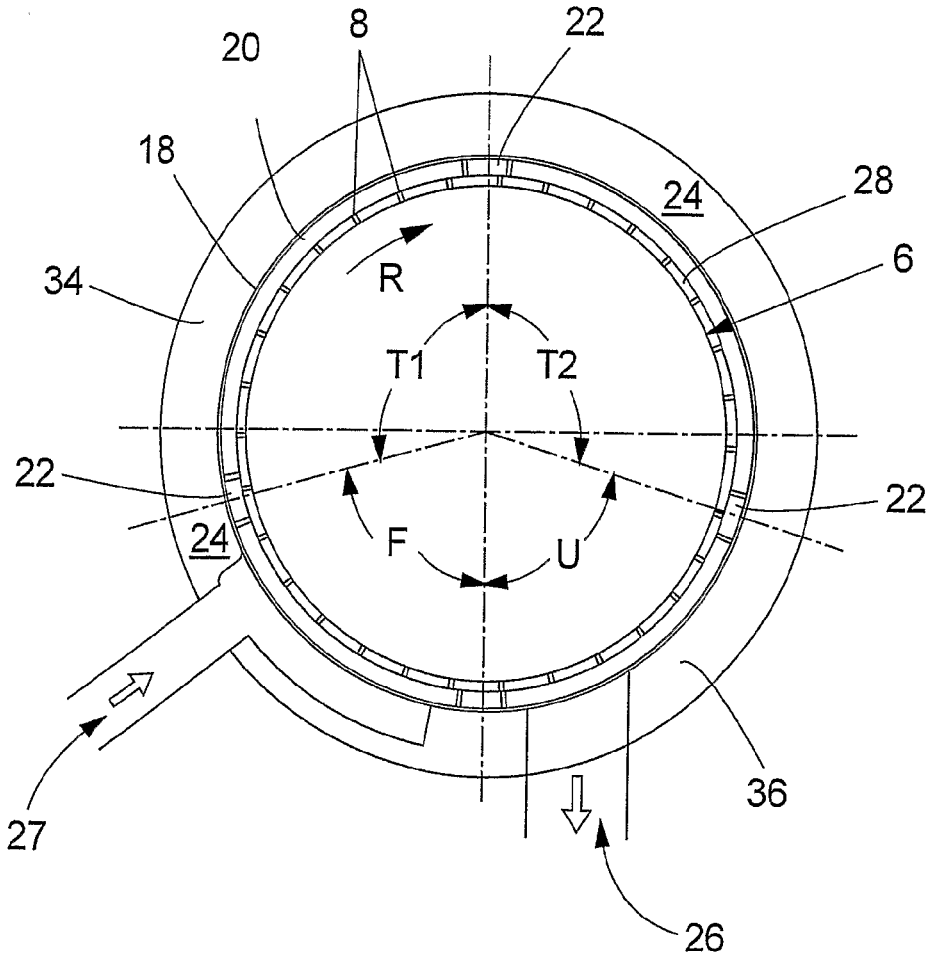

The present invention will now be described more in detail in embodiments, with reference to the attached drawings, without limiting the interpretation of the invention thereto, in which FIG. 1A schematically shows, in a perspective view obliquely from above, a support with a casing to a washing apparatus according to an embodiment of the present invention, FIG. 1B schematically shows, in a perspective view obliquely from below, the support and the casing according to FIG. 1A, FIG. 2 schematically shows, in a perspective view obliquely from above, a drum according to an embodiment of the present invention, intended to be journalled on the support according to FIGS. 1A-B, FIG. 3 schematically shows, in an explanatory sketch, a cross-section A-A through a washing apparatus according to an embodiment of the present invention, where the drum in FIG. 2 is arranged in the support shown in FIGS. 1A-B.

The same reference numerals have been used for corresponding features in the different embodiments shown in FIGS. 1-3.

FIGS. 1A-B and FIG. 2 shows separate main components of a washing apparatus for washing of cellulose pulp, according to the pressurized displacement washer kind. The washing apparatus comprises a rotatable drum 2, provided with a number of outer compartments 4, having a bottom 6 of perforated metal sheet, in which compartments the paper pulp to be washed is placed during feeding on the drum. The compartments 4 are defined by compartment walls 8 arranged axially along the entire axle 10 of the drum and distributed along the circumference 12 of the drum. The washing apparatus comprises a stationary support 14 having two opposite transverse beams 16. The drum 2 extends between the transverse beams and is rotatably journalled on the both transverse beams 16 of the support. A stationary cylindrical casing 18, having two opposite gables 19, encloses the drum 2, whereby an annular space 20 (see FIG. 3) is defined between the casing 18 and the drum 2.

Washing liquid is supplied to the annular space 20 and, at overpressure, the filtrate is caused to pass the perforated metal sheet that forms the bottom 6 in the pulp compartments 4 on the drum 2. The increase in pressure difference results in an improved dewatering of the pulp. The pulp locates itself in the compartments 4 on the drum in long and narrow rectangles towards the metal sheet in the axial direction of the drum. The subdivision in compartments of the drum ensures that the pulp cake does not break up and moves, but instead maintains the form produced at application on the pulp. The perforated metal sheet, on which the pulp deposits, is located on a distance from the axle 10 of the drum such that filtrate channels (not shown) are formed in the space between the drum 2 and the perforated metal sheet. Thus, along the circumference 12 of the drum, there are at least as many filtrate compartments as pulp compartments 4. In a drum washer, several washing stages can be carried out, with separate addition of washing liquid to the various stages and also return of filtrate from one stage as washing liquid to another stage.

In order to maintain maximum washing efficiency, it is desirable to assure that washing liquid intended for a specific washing stage not is transferred to a subsequent washing stage. A pressure difference between the stages results in that added washing liquid aims for moving towards the lower pressure. For the purpose of being able to separate different washing stages T1, T2, and also formation stage F and discharge stage U, the respective zones are sealed with axial seals 22. The axial seals are positioned between the rotating drum 2 and the surrounding casing 18. The filtrates from the respective stages are separated by seals in a peripheral end valve arranged at one or both gables of the drum. As evident from FIG. 3, the washing apparatus comprises several seals 22 arranged on the casing 18 and that seals between the casing and the compartment walls 8 of the compartments, such that the annular space 20 is divided in a formation zone F for forming of the pulp in the compartments of the drum 4, during rotation of the drum in clockwise direction R, a first washing zone T1 and a second washing zone T2 for washing of the formed pulp at overpressure, and a discharge zone U for discharge of the washed pulp via a discharge opening 26 from the annular space. Pulp to be washed is fed in the formation zone via the inlet opening 27. In the pressurized displacement washer, the increase in pressure difference may result in that the pulp web gets stuck harder towards the metal sheet of the drum and sometimes has to be removed by some kind of aid. Then, the pulp web can e.g. be unfastened by means of liquid or air.

Again with reference to FIGS. 1A-B, the washing apparatus comprises at least a reinforced frame rib 24, which is attached to the casing 18 between the gables 19. According to the invention, the reinforced frame rib 24 extends around the entire casing 18 for fixing the casing in a predetermined form, whereby detrimental deformation of the casing, when washing the paper pulp at overpressure in the pressurized spaces, can be prevented. In the case the washing apparatus only comprises one reinforcing frame rib, the frame rib is suitably arranged in the axial centre C of the washing apparatus. If the washing apparatus has a large length/diameter proportion, several frame ribs can be used, which then are positioned symmetrically around the centre C of the washing apparatus. The purpose is to achieve an equally large deformation on each side of the reinforcing frame rib, that will arise due to the internal overpressure.

Again with reference to FIG. 3, an overpressure in the formation zone F and the washing zones T1, T2 results in that the attachments for the longitudinal seals 22' will be deformed and moved away from its nominal positions. Such a movement is lowered in an effective way by the reinforcing frame rib 24 around the entire casing 18.

As evident from FIG. 1B, the casing forms a longitudinal discharge opening 26, relatively the axial extension of the drum, for washed pulp that is discharged from the discharge zone U, and the reinforcing frame rib 24 extends straight across the discharge opening 26 of the casing. In that respect, the drum 2 may suitably be provided with at least an encircling ring 28, as is evident from FIG. 2, that extends in the circumferential direction of the drum 2 and is located axially opposed to the reinforcing frame rib 24 of the casing 18. The function of the ring 28 is to eliminate that the pulp cake in the discharge zone U ends up between the drum 2 and the frame rib 24 during discharge of the compartments 4. In case the washing apparatus comprises several reinforcing frame ribs 24, the drum can preferably be provided with corresponding number of rings 28, which then are positioned axially opposed to the frame ribs.

Furthermore, the casing may preferably as evident from FIGS. 1A-B have a number of oblong openings 30 that extends axially relatively the drum 2. The seals 22 are arranged in the openings 30, and the reinforced frame rib 24 extends straight across the oblong openings 30 of the casing. In this respect, stiffened wall portions 32 can be fixed between the gables 16 and the frame rib 24 along and adjacent to the openings 30. These stiffened wall portions 32, along the openings 30 in which the seals 22 are to be placed, are fixed by means of the reinforcing frame rib 24 around the casing 18 and the function of the washing apparatus is maintained, and by that, the risk for an altered geometrical position of the seals 22 is minimized.

The frame rib 24 can also be divided in sections that are fixed to each other according to a not shown embodiment. In that respect, the frame rib is suitably divided in two sections, one upper section 34 that extends around the upper half around the casing 18 and a lower section 36 that extends around the lower half of the casing 18, whereby the lower section 36 extends straight across the discharge opening 26 of the casing. The sections 34, 36 can be fixed to each other e.g. with screw joint reinforcement.

The casing 18, the reinforcing frame rib/ribs 24 and the stiffened wall portions 32 are made from initially plane metal sheet elements.

The invention claimed is:

1. A washing apparatus for washing cellulose pulp comprising:

a rotatable drum including a plurality of outer compartments for the cellulose pulp to be washed, said plurality of outer compartments defined by axial compartment walls distributed along the circumference of said rotatable drum, a stationary cylindrical casing comprising a pair of opposite gables, enclosing said rotatable drum, whereby an annular space is defined between said stationary cylindrical casing and said rotatable drum, a plurality of seals arranged on said stationary cylindrical casing so as to create seals between said stationary cylindrical casing and said axial compartment walls, thereby dividing said annular space into a formation zone for forming said cellulose pulp in said plurality of outer compartments of said rotatable drum, at least one washing zone for washing said formed pulp at an overpressure, and a discharge zone for discharge of said washed pulp from said annular space; and at least one reinforcing frame rib, attached to said stationary cylindrical casing between said pair of opposite gables, said at least one reinforcing frame rib extending around said entire stationary cylindrical casing for fixing said casing in a predetermined form, whereby detrimental deformation of said stationary cylindrical casing during washing of said cellulose pulp in said at least one pressurized washing zone is prevented, said stationary cylindrical casing forming a longitudinal discharge opening, relative to the axial extension of said rotatable drum, for washed pulp that is discharged from said discharge zone, and wherein said at least one reinforcing frame rib extends across said discharge opening of said stationary cylindrical casing.

2. Washing apparatus according to claim 1, wherein said rotatable drum is provided with at least one encircling ring, extending in the circumferential direction of said rotatable drum and located axially opposed to said at least one reinforcing frame rib.

3. Washing apparatus according to claim 1 wherein said stationary cylindrical casing includes a plurality of oblong openings extending axially relative to said rotatable drum, said plurality of seals being arranged in said plurality of oblong openings, and said at least one reinforcing frame rib extending straight across said plurality of oblong openings.

4. Washing apparatus according to claim 3, including stiffened wall portions fixed between said pair of opposite gables and said at least one reinforcing frame rib adjacent to said plurality of oblong openings.

5. Washing apparatus according to claim 4, wherein said stationary cylindrical casing, said at least one reinforcing frame rib and said stiffened wall portions are produced from plane sheet metal elements.

6. Washing apparatus according to claim 1 wherein said at least one reinforcing frame rib is divided into sections that are fixed to each other.

7. Washing apparatus according to claim 6, wherein said at least one reinforcing frame rib is divided into a pair of sections, including an upper section extending around the upper half of said stationary cylindrical casing and a lower section extending around the lower half of said stationary cylindrical casing, whereby said lower section extends straight across said discharge opening.

8. Washing apparatus according to claim 1, wherein said washing apparatus comprises a single reinforcing frame rib arranged in said axial center of said washing apparatus.

9. Washing apparatus according to claim 1, wherein said washing apparatus comprises a plurality of said reinforcing frame ribs positioned symmetrically around the center of said washing apparatus.

* * * * *